US007584704B2

(12) United States Patent
Schutte et al.

(10) Patent No.: US 7,584,704 B2
(45) Date of Patent: Sep. 8, 2009

(54) ASSEMBLY FOR ALIGNING AND INTERLOCKING AN ELECTRO-MONORAIL SYSTEM AND VERTICAL LIFT STATION

(75) Inventors: David E. Schutte, Lynnville, TN (US); James D. Oakley, Columbia, TN (US)

(73) Assignee: GM Global Technology Operations, Inc., Detroit, MI (US)

( * ) Notice: Subject to any disclaimer, the term of this patent is extended or adjusted under 35 U.S.C. 154(b) by 224 days.

(21) Appl. No.: 11/685,218

(22) Filed: Mar. 13, 2007

(65) Prior Publication Data

US 2008/0223248 A1 Sep. 18, 2008

(51) Int. Cl.
*B61B 13/00* (2006.01)

(52) U.S. Cl. ..... 104/129; 104/128

(58) Field of Classification Search ..... 104/124, 104/127, 128, 129, 130.01–130.04; 187/207, 187/216, 308, 309, 310, 400
See application file for complete search history.

(56) References Cited

U.S. PATENT DOCUMENTS

| | | | | |
|---|---|---|---|---|
| 1,958,940 | A * | 5/1934 | Cavanaugh et al. | 292/144 |
| 2,747,535 | A * | 5/1956 | Curry | 269/34 |
| 3,783,792 | A * | 1/1974 | Cullom | 104/128 |
| 4,094,252 | A * | 6/1978 | Pater et al. | 104/130.01 |
| 5,312,074 | A * | 5/1994 | Keith et al. | 246/430 |

* cited by examiner

*Primary Examiner*—S. Joseph Morano
*Assistant Examiner*—Zachary Kuhfuss

(57) ABSTRACT

An assembly adapted for aiding the alignment of and interlocking a vertical lift station (VLS) rail and the main rail of an electro-monorail system (EMS), the assembly includes a locator pin, a pin receiver having tapered walls for funneling the pin towards an aligned position, and a clamping device fixedly attached to the main rail and configured to apply a holding force to the pin, so as to hold the rails in a fixed condition.

9 Claims, 7 Drawing Sheets

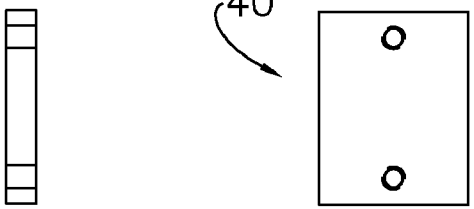
FIG. 10
FIG. 10a
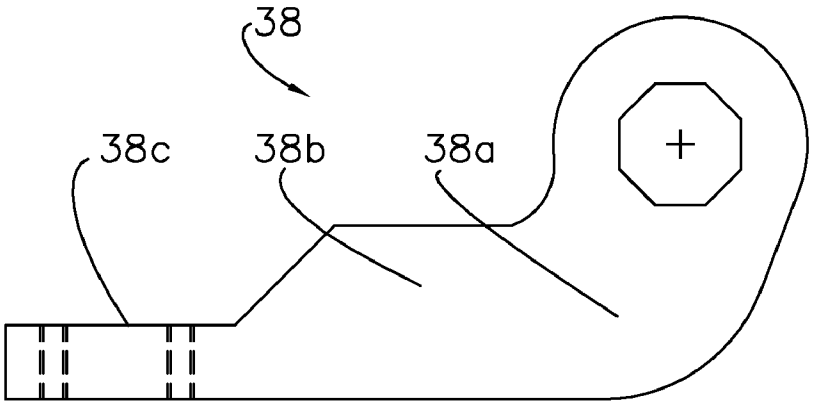
FIG. 9
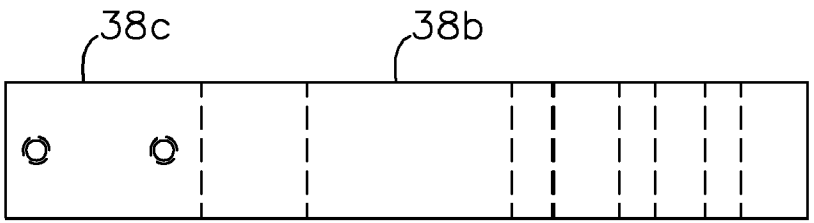
FIG. 9a

ASSEMBLY FOR ALIGNING AND INTERLOCKING AN ELECTRO-MONORAIL SYSTEM AND VERTICAL LIFT STATION

BACKGROUND OF THE INVENTION

1. Field of the Invention

The present invention relates generally to electro-monorail systems (EMS) that interact with vertical-lift-stations (VLS), and more particularly to an assembly for aiding the alignment of and interlocking the EMS and VLS in a fixed condition.

2. Discussion of Prior Art

Electro-monorail systems (EMS) have been developed to facilitate the assembly, fabrication and inventory of a multi-step multi-nodal process. In the automotive industry, for example, EMS are frequently utilized to facilitate the stamping, welding, painting, or general assembly processes of an auto-body work in progress. These systems utilize a main rail to interconnect a plurality of nodes, and support a carrier that is propelled from node to node by continuous electric potential within the rail. As such, the load carrying main rail includes a series of conductive slats and shoes followed by a grounding slat. The carrier includes a series of front and rear bushings for receiving the oscillating electric current, and wheels which rollingly engage raceways defined by the main rail. Where overhead EMS configurations are provided, each node typically features a vertical lift station (VLS) that translates into and out of an operable position, wherein a VLS rail is positioned adjacent the EMS main rail. Once in position, the carrier is able to travel upon the VLS rail, so as to be lowered within the work cell. Finally, when the work is complete, the VLS is raised to the operable position, so that the carrier can proceed to the next station.

The entry and exit of the carrier upon the VLS rail, however, present commonly experienced concerns caused by misalignment and/or deflection. More particularly, it is appreciated by those of ordinary skill in the art that as the carrier enters the VLS rail, the VLS descends a small yet significant dimension. This action by the VLS causes, among other things, the rear bushing of the carrier to drag on the main rail. By catching the end of the carrier, a downward force equal to the weight of the carrier and payload acts upon the end of the main rail. As a result, the relatively lightweight main rail, which is often formed of aluminum, may be caused to inelastically deform due to insufficient structural capacity. As the carrier exits the VLS, the descended configuration may cause the carrier to strike the EMS at the exit point, which may further cause inelastic deformation at the exit point. Meanwhile, the front and rear bushings of the carrier are often damaged from constant dragging and striking of the main rail.

Various measures have been implemented to structurally support and reduce misalignment and deflection at the EMS-VLS interface, including the addition of massive steel beams to reinforce the existing framework. These measures have achieved little success and have not been incorporated due to costs, work cell space, and inefficiency of operation. Instead, damaged EMS, VLS rail, and carrier components are typically allowed to undergo gradual degradation until replacement.

Thus, there remains a need in the art for an improved measure for reducing the likelihood of misalignment and deflection at an EMS-VLS interface, and the damages caused thereby.

BRIEF SUMMARY OF THE INVENTION

Responsive to this need, the present invention concerns an assembly for aiding alignment and interlocking a main rail of an EMS and a VLS rail. The assembly aids the proper alignment of the VLS rail as it translates into an operable position adjacent the main rail. The assembly further includes a clamping device for holding the main and VLS rails in a fixed condition, so as to reduce the likelihood of deflection during carrier translation on and off of the VLS rail. As such, the invention is useful for extending the useful life of the main rail, VLS rail, and carrier, and reducing repair and replacement costs associated therewith.

A first aspect of the present invention generally concerns the configuration of the assembly for aiding the alignment of the VLS rail and main rail, as the VLS translates into the operable position. In this regard, the assembly includes an elongated locator pin fixedly connected to the VLS rail at or near the interface, and presenting an average cross-sectional pin diameter. The assembly further includes a receiver fixedly connected to the main rail at or near the interface. The receiver includes a cradle having divergently tapered walls, so as to present a maximum cradle wall spacing at and a minimum cradle wall spacing opposite the distal end of the walls. The pin and receiver are cooperatively configured so that the pin diameter is less than the maximum cradle wall spacing and greater than the minimum spacing, and cooperatively positioned so that the pin enters the cradle and is funneled towards the minimum spacing as the VLS rail translates into the operable position.

A second aspect of the present invention concerns the configuration of the assembly for interlocking the VLS and main rails in a relatively fixed condition. In this regard, the assembly includes an EMS engaging structure fixedly attached to the main rail at or near the interface. The assembly also includes a VLS rail engaging structure fixedly attached to the VLS rail at or near the interface. Lastly, the assembly includes a clamping device configured to produce a holding force when the VLS rail is in the operable position and the structures are attached to the main and VLS rails. The clamping device is configured to apply the force to the EMS and VLS rail engaging structures, so that the main and VLS rails are biased towards and held in the fixed condition.

Yet further aspects, embodiments, and advantages of the present invention, including the use of a pneumatic power clamp having a toggle lock, and a magnetized pin and receiver combination, will be apparent from the following detailed description of the preferred embodiment(s) and the accompanying drawing figures.

BRIEF DESCRIPTION OF THE SEVERAL VIEWS OF THE DRAWING

A preferred embodiment(s) of the invention is described in detail below with reference to the attached drawing figures, wherein:

FIG. 9 is a side elevation view of a swing arm in accordance with a preferred embodiment of the present invention;

FIG. 9*a* is a bottom view of the swing arm shown in FIG. 9, particularly illustrating the lift pad engaging holes;

FIG. 10 is a top view of a lift pad adapted for connecting to the swing arm and engaging the locator pin, in accordance with a preferred embodiment of the present invention;

FIG. 10*a* is a side elevation view of the lift pad shown in FIG. 10;

DETAILED DESCRIPTION OF THE INVENTION

Figure 1:
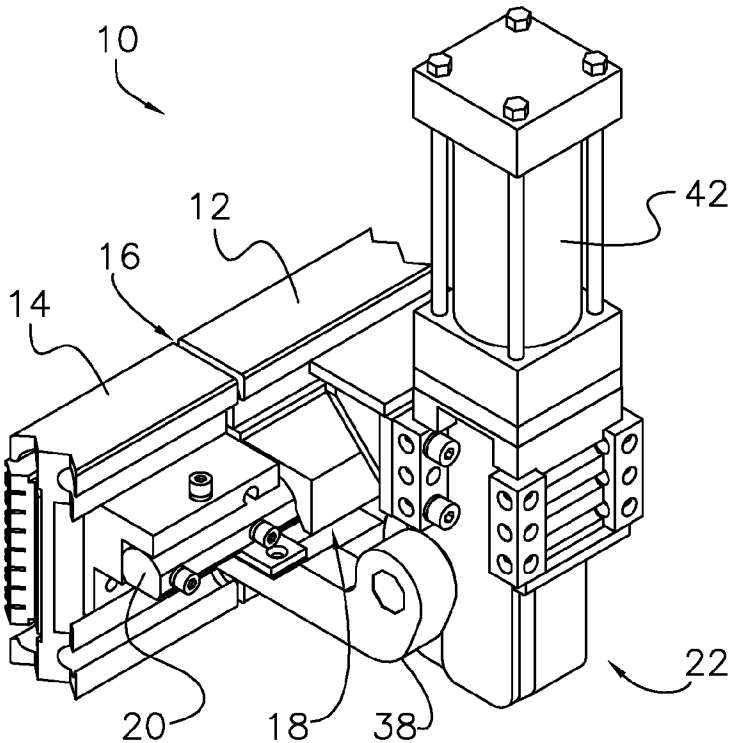
FIG. 1 is a rearward isometric view of an aligning and interlocking assembly having a left swing arm in accordance with a preferred embodiment of the present invention, a partial segment of an EMS main rail, and a partial segment of a VLS rail.
Figure 2:
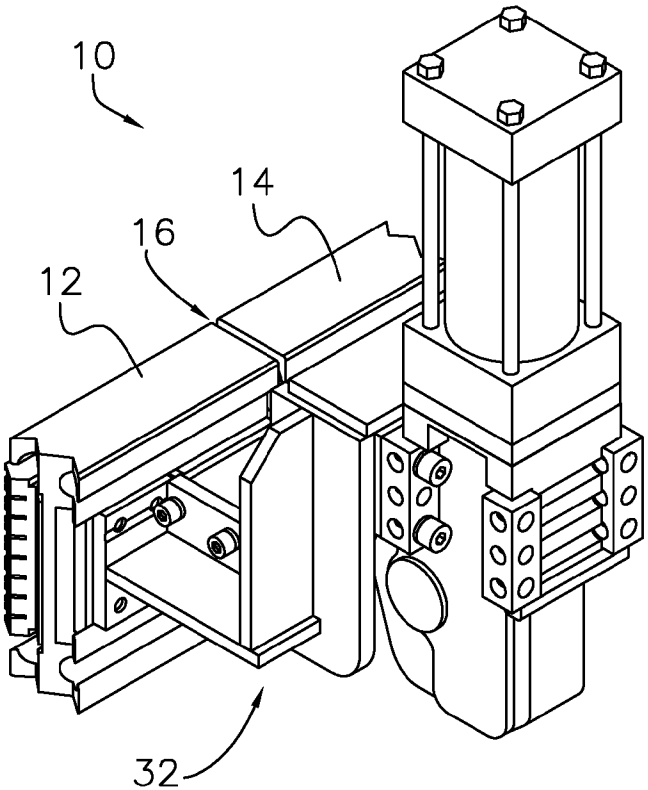
FIG. 2 is a rearward isometric view of an aligning and interlocking assembly having a right swing arm in accordance with a preferred embodiment of the present invention, a partial segment of an EMS main rail, and a partial segment of a VLS rail.
Figure 3A:
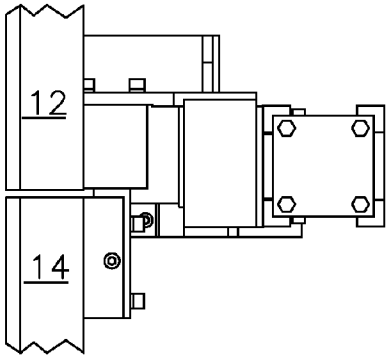
FIG. 3*a* is a top view of the assembly, partial EMS main rail, and partial VLS rail shown in FIG. 1.
Figure 3D:
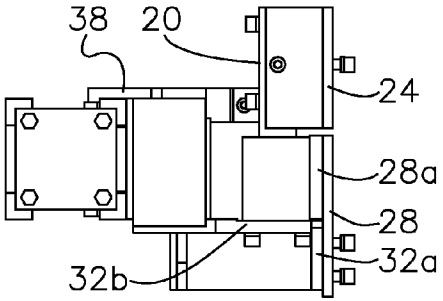
FIG. 3*d* is a top view of the assembly shown in FIG. 1, particularly illustrating the main and VLS rail interconnecting fasteners.
Figure 3B:
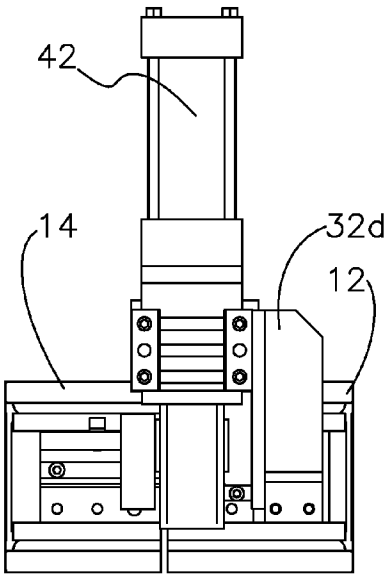
FIG. 3*b* is a rear elevation view of the assembly, partial EMS main rail, and partial VLS rail shown in FIG. 1.
Figure 3C:
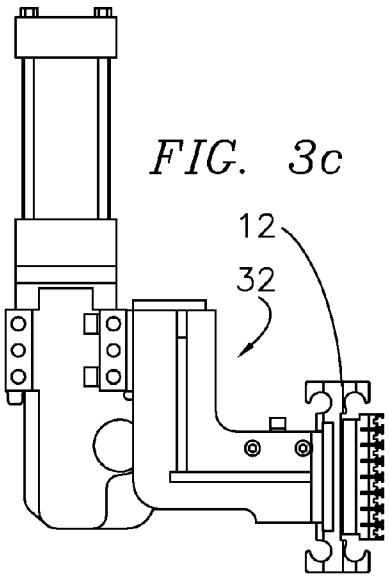
FIG. 3*c* is a right side elevation view of the assembly, partial EMS main rail, and partial VLS rail shown in FIG. 1, particularly illustrating a multi-section bracket interconnecting the clamping device and EMS main rail.
Figure 3:
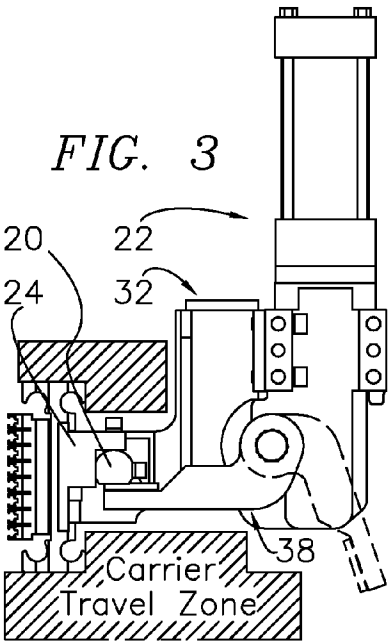
FIG. 3 is left side elevation view of the assembly, partial EMS main rail, and partial VLS rail shown in FIG. 1, particularly illustrating a left swing arm clamping device, and a locator pin and pin holder fixedly attached to the VLS rail.

As best shown in FIGS. 1 and 2, the present invention concerns an assembly 10 for aiding the alignment of and interlocking in a fixed condition a main rail 12 of an electromonorail system (EMS) and a vertical lift station (VLS) rail 14. The assembly 10, as henceforth described and illustrated, is duplicitously added to the pre-existing EMS-VLS combination at each interface 16 (i.e., each point of entry and exit to each station) defined by the rails 12, 14. Each assembly 10 provides additional structural rigidity at the interface, produces a holding force that acts to reduce deflection and recession during load transfer, and promotes the proper alignment of the VLS rail 14 as it translates to an operable position adjacent the main rail 12. The assembly 10 is further configured so as not to obstruct the carrier travel zone (FIG. 3).

Figure 2A:
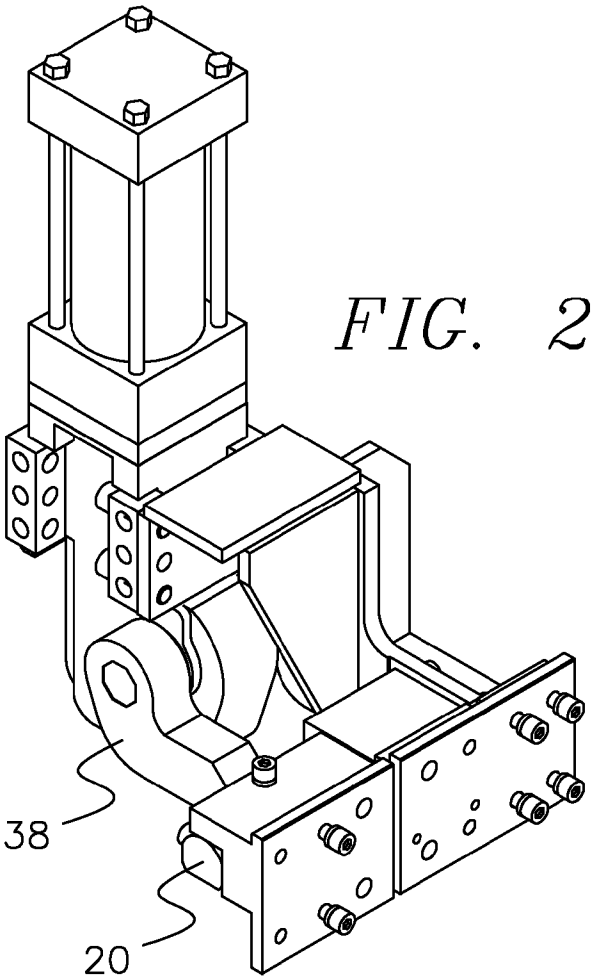
FIG. 2*a* is a frontward isometric view of the assembly shown in FIG. 2.
Figure 4C:
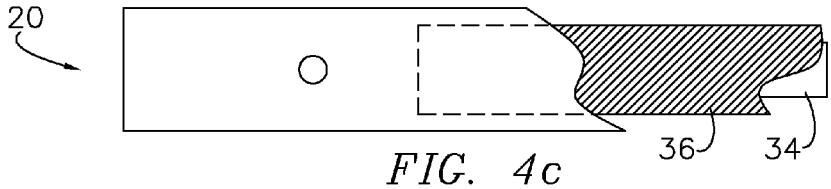
FIG. 4*c* is a top view of a locator pin in accordance with a preferred embodiment of the present invention, particularly illustrating a wire coil and a magnetically permeable core.
Figure 4B:
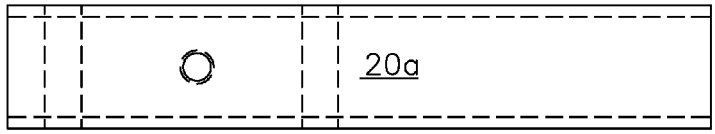
FIG. 4*b* is a top view of the locator pin shown in FIG. 4.
Figure 4:
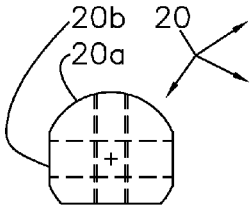
FIG. 4 is a front elevation view a locator pin in accordance with a preferred embodiment of the present invention.
Figure 4A:
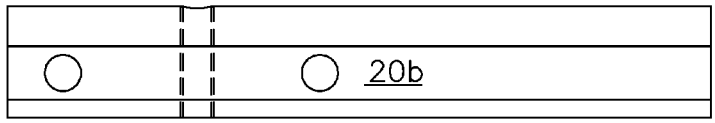
FIG. 4*a* is a side elevation view of the locator pin shown in FIG. 4.

Turning to the structural configuration of the illustrated embodiment, the assembly 10 generally includes a receiver 18, a locator pin or rod 20, and more preferably, a clamping device 22. As shown in FIGS. 1 through 3*d*, the receiver 18 and locator pin 20 are cooperatively configured so that the locator pin 20 enters the receiver 18 as the VLS rail 14 is raised into the operable position. The locator pin 20 is fixedly attached to the VLS rail 14 at or near the interface 16. As shown in FIGS. 4, 4*a* and 4*b*, the pin 20 presents an elongated member having a longitudinal length and a maximum cross-sectional diameter. The pin length is dimensioned in accordance with relative pin and receiver spacing, and more particularly to ensure that a sufficient portion (e.g., at least 25%) of the pin 20 is received by the receiver 18. It is therefore preferable to abut the pin 20 and receiver 18 adjacent the interface 16 (FIGS. 1 through 2*a*). The pin 20 presents an oblong cross-sectional shape (FIG. 4) that defines a curvilinear upper receiver engaging surface 20*a*, and flat structure and device engaging surfaces 20*b*, which promote flush interaction therewith. As also shown in FIGS. 4*a-b*, the pin 20 defines at least one fastener receiving hole to facilitate interconnection.

Figure 5:
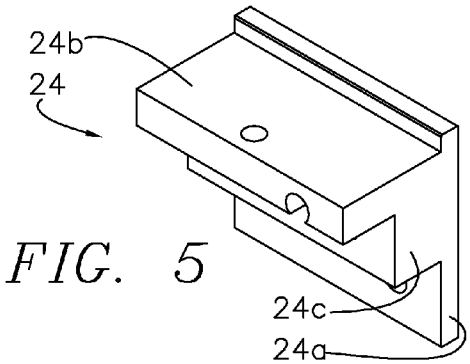
FIG. 5 is an isometric view of a VLS rail engaging pin holder adapted for interconnecting a locator pin and the VLS rail, in accordance with a preferred embodiment of the present invention.
Figure 5C:
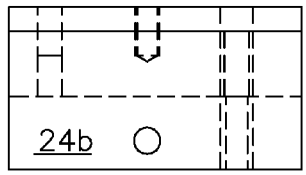
FIG. 5*c* is a top view of the pin holder shown in FIG. 5.
Figure 5A:
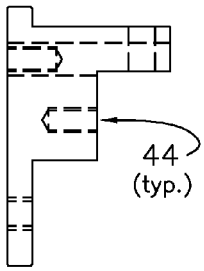
FIG. 5*a* is a side elevation view of the pin holder shown in FIG. 5.
Figure 5B:
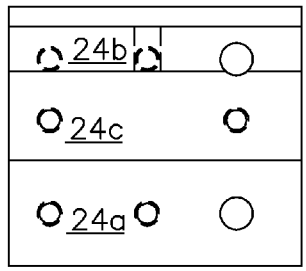
FIG. 5*b* is a front elevation view of the pin holder shown in FIG. 5.

The preferred assembly 10 includes a VLS engaging structure or pin holder 24 for interconnecting the pin 20 and VLS rail 14 (FIGS. 1 and 2*a*). As shown in FIGS. 5 through 5*c*, the pin holder 24 presents an angle member having a VLS rail engaging leg 24*a*, a device engaging leg 24*b*, and a raised section 24*c* for added resistance to bending. As shown in FIGS. 1, 2 and 3, the pin holder 24 is configured to retain the pin 20 adjacent the angle defined by the raised section 24*c* and device engaging leg 24*b*. To that end, the holder 24 defines two dowel receiving holes within the raised section 24*c* and a perpendicular through-hole within the device engaging section 24*b* (FIG. 5*a*) for aligning with the pin 20 and receiving a plurality of removable fasteners 25 (typ.), such as bolts, plugs, dowels, etc. The remainder of the holes are defined by the VLS engaging section 24*a* and includes at least one dowel hole (FIG. 5*a-b*) for connecting to the VLS rail. Thus, the device engaging and raised sections 24*b-c* are cooperatively configured to space the pin 20 from the VLS rail 14, and provide a sufficient catch for engaging the clamping device 22.

Figure 6:
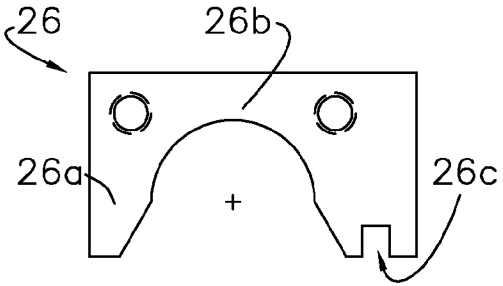
FIG. 6 is a front elevation view of a receiver cradle in accordance with a preferred embodiment of the present invention.
Figure 6A:
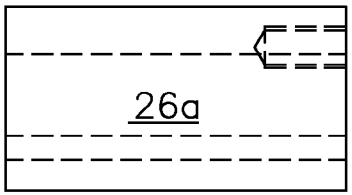
FIG. 6*a* is a side elevation view of the cradle shown in FIG. 6.

As shown in FIGS. 6 and 6*a*, the preferred receiver 18 includes a cradle 26 comprising two projecting side walls 26*a*. The walls 26*a* define divergently tapered inner wall surfaces that cooperate to present a maximum wall spacing at and a minimum wall spacing opposite the distal end of the walls 26*a*. The cradle 26 and pin 20 are cooperatively configured so that the maximum pin diameter is less than the dimension of the maximum spacing but larger than the minimum wall spacing. In this configuration, it is appreciated that the tapered configuration of the walls 26*a* acts to funnel the pin 20 towards the minimum spacing, thereby guiding the pin 20 and attached VLS rail 14 towards the alignment defined by the minimum spacing. In the illustrated embodiment, the minimum wall spacing further presents a seat 26*b* opposite the distal end of the walls 26*a*. The seat 26*b* and pin 20 are cooperatively configured to form superjacent layers. More particularly, the seat 26*b* presents a curved surface having a lateral radius of curvature slightly greater than (e.g., 105%) the radius of curvature that defines the receiver engaging pin surface 20*a*.

Figure 7A:
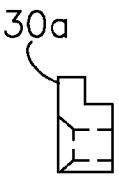
FIG. 7*a* is front elevation view of the key shown in FIG. 7.
Figure 7:
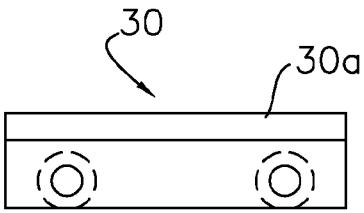
FIG. 7 is a side elevation view of a receiver key for engaging the receiver cradle in accordance with a preferred embodiment of the present invention.

As assembled, the cradle 26 is adjacently positioned next to an EMS/receiver mounting plate 28. At its base, the cradle 26 defines a notch 26*c* for receiving a receiver key 30. More particularly, and as shown in FIGS. 7 and 7*a*, the receiver key 30 presents an elongated rectangular member having a key projection 30*a* configured to be inserted within the notch 26*c*. The key 30 is oriented within the notch 26*c*, so as to also be adjacent the plate 28 (FIGS. 6 and 7*a*). Finally, the key 30 defines a plurality of plate engaging holes that function to fixedly connect the key 30, and therefore the cradle 26 to the plate 28 (FIG. 7).

Figure 8A:
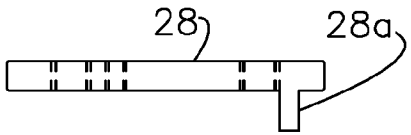
FIG. 8*a* is a side elevation view of the mounting plate shown in FIG. 8.
Figure 8:
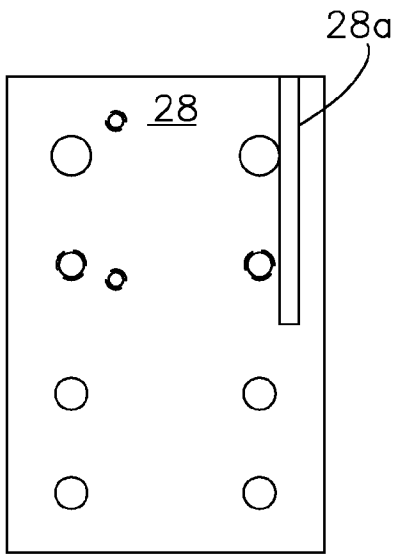
FIG. 8 is a top surface view of an EMS bracket/receiver mounting plate for interconnecting the receiver cradle and bracket to the EMS main rail in accordance with a preferred embodiment of the present invention, particularly illustrating a plurality of engaging holes and a cradle stop projection.
Figure 8B:
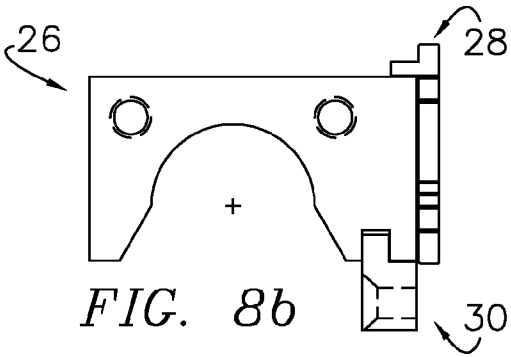
FIG. 8*b* is a front elevation view of a partial assembly in accordance with a preferred embodiment of the present invention, wherein the cradle shown in FIG. 6 is in a vertically fixed positioned defined by a receiver key shown in FIG. 7 and the mounting plate shown in FIG. 8.

As shown in FIGS. 8 and 8*a*, the EMS/receiver mounting plate 28 presents a planar rectangular structure for interconnecting the cradle 26 and EMS engaging structure 32 to the EMS rail 12. As such, the preferred mounting plate 28 defines a plurality of engaging through-holes for adjustable interconnection with the EMS structure 32, key 30, and rail 12. The preferred mounting plate 28 further defines a mounting plate projection 28*a* parallel to the long sides of the rectangle, and extending from a short side near one corner to the mid-point of the adjacent long side (FIG. 8). The mounting plate projection 28*a* functions as a stop for the cradle 26, so that the key 30 and stop 28*a* are cooperatively configured to hold the cradle 26 in a vertically fixed position as shown in FIG. 8*b*.

The structural components of the assembly 10, including the pin 20, receiver 18, and VLS engaging structure 24, are preferably formed of high-grade steel or another material comparable in compression, tensile and shear strength. In an alternative embodiment, however, the locator pin 20 and receiver 18 further present magnetically attractive elements, so that a holding force is produced when within close proximity of each other. In addition to or in lieu of the clamping device 22, the pin 20 and receiver 18 in this configuration provide an interlocking mechanism for holding the rails 12, 14 in a fixed condition. More preferably, and as shown in FIG. 4*c*, the pin 20 may comprise a highly magnetically permeable core 34 and a wire coil 36 wound around the core 34. The coil 36 is coupled to a controlled source (not shown) of electric potential so that an electric current flow can be produced therein and a resultant magnetic field generated. Thus, as is appreciated in the art, the pin 20 in this configuration presents a non-permanent magnet that is controllable by an operator. For example, once the pin 20 is received by the receiver 18, the core 34 can be magnetized to lock the rails 12, 14 in place, and then de-magnetized to allow the VLS rail 14 to descend.

More preferably, and as best shown in FIGS. 1 through 3*d*, the assembly 10 further includes a clamping device (or lock) 22 fixedly attached to the stationary EMS rail 12 at or near each interface 16. The assembly 10 includes either a left or right side actuating device 22 (compare, FIGS. 1 and 1*a* (left), and FIGS. 2 and 2*a* (right)) depending upon whether an entry or exit interface is engaged. As previously mentioned, the clamping device 22 is configured to produce the holding force so that it equally and oppositely engages the main and VLS rails 12, 14.

In this configuration, the clamping device 22 includes a pivotal swing arm 38 that presents a distal arm end. The assembly 10 is configured so that the arm 38 contacts and transmits the force to the pin 20 when in the engaging position shown in FIGS. 1 through 2*a*. Once the carrier is properly positioned on the VLS rail 14, the swing arm 38 is able to rotate downward a minimum angle (e.g., 30 degrees), which allows it to clear the rail 14 as the VLS descends into the work cell. More preferably, the arm 38 is configured to swing at least 60 and not more than 120 degrees (see, FIG. 3 showing the rotated arm in hidden-line). To that end, the clamping device 22 further functions to also produce a return force that causes the arm to disengage the pin 20 and swing downward.

The arm 38 presents an integral structure that features an arched elbow 38*a* and a raised portion 38*b* for added structural capacity (see FIGS. 9 and 9*a*). At the distal end of the arm 38, a lift pad engaging section 38*c* is presented for connecting the arm 38 to a lift pad 40 (FIGS. 10 and 10*a*). The pad engaging section 38*c* defines a flat engaging surface and a plurality of engaging holes for aligning with a plurality of engaging holes defined by the lift pad 40.

The preferred arm 38 is pivotably coupled to a driven mechanism (not shown) that is fluidly coupled to a pneumatic power source (also not shown). As such, the clamping device 22 further includes an accumulator tank 42 that is fluidly coupled to the source, and configured to equilibrate, so that a constant air pressure (e.g., 80 psi) is maintained. Alternatively, however, the clamping device 22 may be driven by conventional electro, electromechanical, or hydraulic means. Finally, the preferred clamping device 22 also includes a toggle-lock mechanism (also not shown), so that once the arm 38 swings past an activation point towards the engaging position, the mechanism locks the arm 38 in place to guard against a sudden loss of air pressure. The return force, in this configuration, causes the toggle-lock to reset.

Figure 1A:
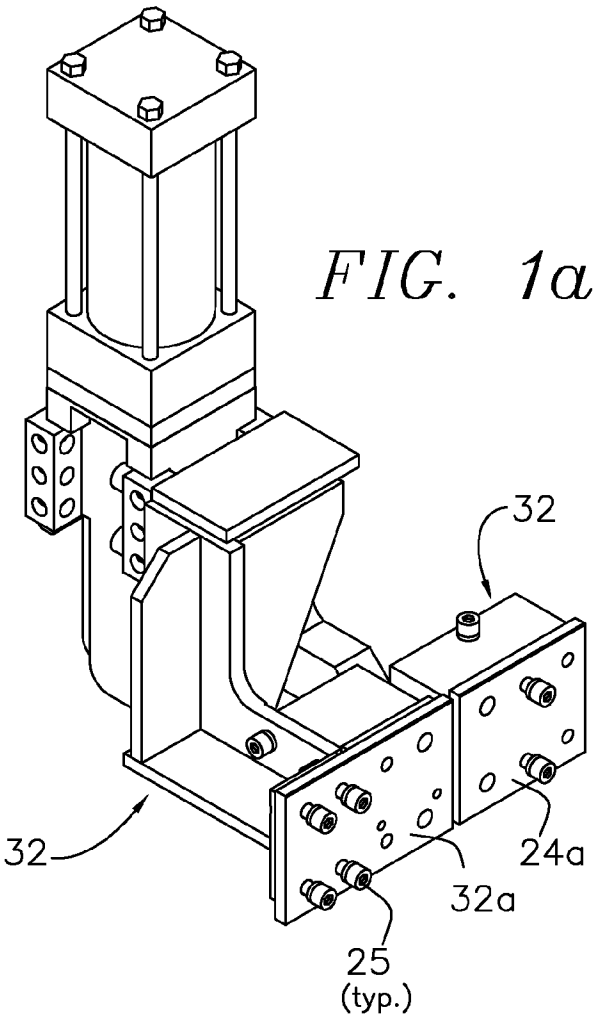
FIG. 1*a* is a frontward isometric view of the assembly shown in FIG. 1.
Figure 11A:
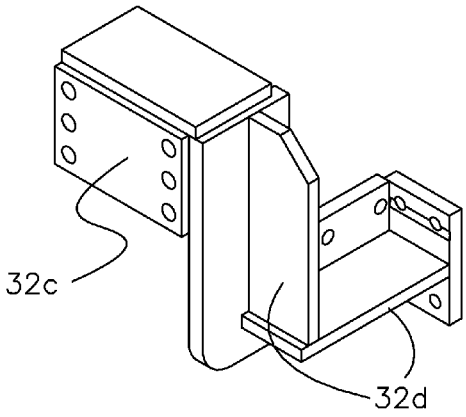
FIG. 11*a* is a right rearward isometric view of the structure shown in FIG. 11.
Figure 11:
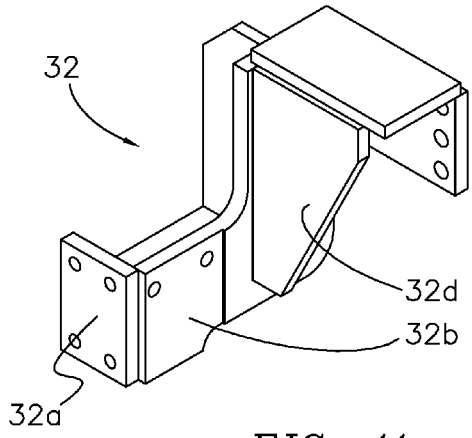
FIG. 11 is left rearward isometric view of an EMS engaging structure (multi-section bracket) adapted for interconnecting the clamping device, receiver cradle, and EMS main rail, in accordance with a preferred embodiment of the present invention.
Figure 11B:
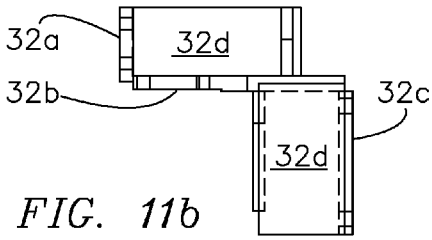
FIG. 11*b* is a top view of the structure shown in FIG. 11.
Figure 11C:
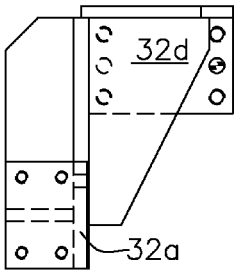
FIG. 11*c* is a front elevation view of the structure shown in FIG. 11, particularly illustrating the EMS main rail engaging section.
Figure 11D:
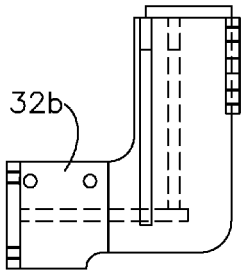
FIG. 11*d* is a left elevation view of the structure shown in FIG. 11, particularly illustrating the receiver engaging section.
Figure 11E:
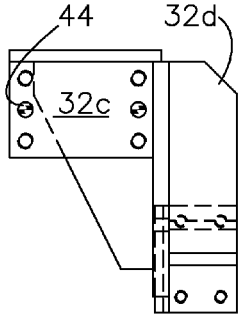
FIG. 11*e* is a rear elevation view of the structure shown in FIG. 11, particularly illustrating the clamping device engaging section.

As previously mentioned and shown in FIGS. 1*a* and 2, the clamping device 22 is fixedly connected to the EMS main rail 12 by an EMS engaging structure 32. As shown in FIGS. 11 through 11*e*, the preferred structure 32 presents a multi-section bracket. More particularly, the bracket 32 comprises planar EMS engaging, receiver engaging, and device engaging sections 32*a-c*, wherein the receiver engaging section 34*b* is orthogonally oriented relative to the other two sections 32*a,c*. The sections 32*a-c* define a series of fastener receiving holes for alignment with the aforementioned device 22, receiver 18, and main rail 12, and for receiving a plurality fasteners. For example, the EMS engaging section 32*a* defines a plurality of four holes, the receiver section 32*b* defines two upper region holes for connecting to the cradle 26, and the device engaging section 32*c* defines a plurality of six holes, wherein the middle two are dowel receptacles 44 (typ.). For added structural rigidity, the preferred bracket 32 further includes a series of longitudinal flare sections 32*d* perpendicularly buttressing the EMS, receiver, and device engaging sections 32*a-c*.

To effect the autonomous function of the assembly 10, the EMS or VLS are preferably communicatively coupled to the clamping device 22. More particularly, the EMS or VLS is configured to notify the clamping device 22 when the VLS rail 14 is in the operable position, and as such further includes necessary sensory and communication technology. In this configuration, the preferred clamping device 22 is programmably configured to produce the force only upon notification that the VLS rail 14 is in the operable position. Further, the clamping device 22 preferably includes a sensor (not shown) operable or is otherwise configured to determine when the swing arm 38 is in the engaging position. To avoid damaging the clamping device 22 or VLS rail 14, the clamping device 22 is configured to notify the VLS when the swing arm 28 is or is not in the engaging position, and the VLS is configured to translate to the operable position only when the arm 28 is not in the engaging position. Finally, it is further desirous for the carrier to be communicatively coupled to the clamping device 22, so as to inform the clamping device 22 of its departure from the station. In this respect, the clamping device 22 is preferably configured to produce the return force and disengage the pin 20, only when notified of the departure of the carrier. The VLS or EMS, clamping device 22, and carrier may communicate through conventional wire or wireless technology, and be interfaced by a programmable controller (also not shown).

Further and more detailed structural disclosure is provided in the various figures (see generally, FIGS. 1 through 11*a*) with the understanding that the illustrated embodiment is exemplary in nature, non-exhaustive, and secondary relative to the description of the present invention provided herein.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention. The inventors hereby state their intent to rely on the Doctrine of Equivalents to determine and assess the reasonably fair scope of the present invention as it pertains to any apparatus, assembly, or method not materially departing from but outside the literal scope of the invention as set forth in the following claims.

What is claimed is:

1. An assembly adapted for use with and configured to interlock a vertical lift station (VLS) and an electro-mono rail system (EMS), wherein the VLS includes a VLS rail, the EMS includes a main rail, the VLS rail is translatable into and out of an operable position relative to the EMS, and the main and VLS rails are adjacent in the operable position, so as to cooperatively define an EMS-VLS interface, said assembly comprising:

an EMS engaging structure fixedly attached to the main rail at or near the interface;

a VLS rail engaging structure fixedly attached to the VLS rail at or near the interface; and a clamping device configured to produce a holding force when the VLS rail is in the operable position and the structures are attached to the main and VLS rails, and further configured to apply the force to the EMS and VLS rail engaging structures, so that the main and VLS rail are biased towards and held in the fixed condition, wherein said device, EMS and VLS are communicatively coupled, the EMS or VLS is configured to notify the device when the VLS rail is in the operable position, and the device is configured to produce the force only upon notification that the VLS rail is in the operable position, wherein said VLS rail engaging structure includes an angle member having a rail engaging leg and a device engaging leg projecting from the rail engaging leg, so as to present a distal end, and said rail engaging leg is fixedly attachable to the VLS rail, wherein said device includes a translatable device member configured to shift into and out of an engaging position where the translatable member applies the force against the device engaging leg, wherein the translatable device member is a swing arm presenting a distal arm end and a pivot point opposite the distal arm end, said device and VLS rail engaging structure are cooperatively positioned and configured so that the distal arm end projects the force towards the device engaging leg in the engaging position, and said arm is configured to swing a minimum angle at least 30 degrees, so as to facilitate the translation of the VLS rail into and out of the operable position.

2. The assembly as claimed in claim 1, wherein said EMS engaging structure includes a multi-member bracket having an EMS engaging member and a device-engaging member cooperatively configured to fixedly interconnect the device and EMS.

3. The assembly as claimed in claim 1, wherein the device further includes a lift pad fixedly connected to the swing arm at or near the distal arm end, and presenting a greater surface area for engaging the device engaging leg than the distal arm end.

4. The assembly as claimed in claim 1, wherein said device includes a sensor operable to determine whether said translatable member is in the engaging position, said device is communicatively coupled to the VLS and configured to notify the VLS when the translatable member is or is not in the engaging position, and the VLS is configured to translate to the operable position only when the translatable member is not in the engaging position.

5. An assembly adapted for use with and configured to interlock a vertical lift station (VLS) and an electro-mono rail system (EMS), wherein the VLS includes a VLS rail, the EMS includes a main rail, the VLS rail is translatable into and out of an operable position relative to the EMS, and the main and VLS rails are adjacent in the operable position, so as to cooperatively define an EMS-VLS interface, said assembly comprising:

an EMS engaging structure fixedly attached to the main rail at or near the interface;

a VLS rail engaging structure fixedly attached to the VLS rail at or near the interface; and a clamping device configured to produce a holding force when the VLS rail is in the operable position and the structures are attached to the main and VLS rails, and further configured to apply the force to the EMS and VLS rail engaging structures, so that the main and VLS rail are biased towards and held in the fixed condition;

a locator pin fixedly connected to the VLS rail at or near the interface; and a receiver fixedly connected to the main rail at or near the interface, said pin and receiver being cooperatively positioned and configured so that the pin is received by the receiver when the VLS rail is in the operable position, wherein said EMS engaging structure includes a multi-section bracket having integrally formed EMS engaging, receiver engaging and device engaging sections cooperatively configured to fixedly interconnect the device, receiver, and EMS, and the receiver engaging section is generally orthogonally oriented relative to the EMS and device engaging sections.

6. The assembly as claimed in claim 5, wherein the VLS engaging structure is further configured to interconnect the pin and VLS rail, so as to present a pin holder that spaces the pin from the VLS rail.

7. The assembly as claimed in claim 5, wherein the receiver includes a cradle having divergently tapered walls, so as to present a maximum cradle wall spacing at and a seat opposite the distal end of the walls, the pin presents a cross-sectional diameter less than the maximum cradle wall spacing, and the pin and receiver are cooperatively configured so that the pin enters the cradle and is funneled towards the seat as the VLS rail translates into the operable position.

8. The assembly as claimed in claim 7, further comprising:

a mounting plate defining a first plurality of fastener receiving holes for interconnecting the cradle and main rail; and a receiver key defining a projection and a second plurality of fastener receiving holes, wherein the first and second pluralities of holes are alignable;

said cradle defining a notch configured to receive the projection.

9. An assembly adapted for use with and configured to interlock a vertical lift station (VLS) and an electro-mono rail system (EMS), wherein the VLS includes a VLS rail, the EMS includes a main rail, the VLS rail is translatable into and out of an operable position relative to the EMS, and the main and VLS rails are adjacent in the operable position, so as to cooperatively define an EMS-VLS interface, said assembly comprising:

an EMS engaging structure fixedly attached to the main rail at or near the interface;

a VLS rail engaging structure fixedly attached to the VLS rail at or near the interface; and a clamping device configured to produce a holding force when the VLS rail is in the operable position and the structures are attached to the main and VLS rails, and further configured to apply the force to the EMS and VLS rail engaging structures, so that the main and VLS rail are biased towards and held in the fixed condition, wherein the clamping device includes a pneumatic power source configured to produce the holding force and subsequently produce a return force that causes the holding force to terminate, wherein the clamping device further includes a toggle lock configured to retain the main and VLS rails in the fixed condition when neither of the holding and return forces is applied.

* * * * *